US008636309B2

(12) United States Patent
Müller et al.

(10) Patent No.: US 8,636,309 B2
(45) Date of Patent: Jan. 28, 2014

(54) EXTERNAL HANDLE ON DOORS OR HATCHES OF VEHICLE

(75) Inventors: Ulrich Müller, Velbert (DE); Marion Kilian, Velbert (DE)

(73) Assignees: HUF North America Automotive Parts Mfg Corp., Milwaukee; HUF Huelsbeck & Fuerst GmbH & Co. KG., Velbert (DE)

( * ) Notice: Subject to any disclaimer, the term of this patent is extended or adjusted under 35 U.S.C. 154(b) by 225 days.

(21) Appl. No.: 12/450,003

(22) PCT Filed: Jan. 26, 2008

(86) PCT No.: PCT/EP2008/000619

§ 371 (c)(1),
(2), (4) Date: Sep. 4, 2009

(87) PCT Pub. No.: WO2008/107046

PCT Pub. Date: Sep. 12, 2008

(65) Prior Publication Data

US 2010/0088856 A1 Apr. 15, 2010

(30) Foreign Application Priority Data

Mar. 7, 2007 (DE) ..... 10 2007 011 080
May 25, 2007 (DE) ..... 10 2007 024 594

(51) Int. Cl.
*E05B 3/00* (2006.01)

(52) U.S. Cl.
USPC ..... 292/336.3

(58) Field of Classification Search
CPC ..... E05B 85/16; E05B 63/0056; E04F 15/02; B25G 1/102
USPC ..... 292/336.3, DIG. 53, DIG. 54, DIG. 64; 16/110.1; 340/5.72; 200/600, 511, 514, 200/515, 293.1, 61.85
See application file for complete search history.

(56) References Cited

U.S. PATENT DOCUMENTS 6,374,990 B1 * 4/2002 Swinderman ..... 198/497
6,871,887 B2 * 3/2005 Jooss et al. ..... 292/336.3

(Continued)

FOREIGN PATENT DOCUMENTS

DE 19617038 11/1997
DE 29916091 7/2000

(Continued)

*Primary Examiner* — Kristina Fulton
*Assistant Examiner* — Nathan Cumar
(74) *Attorney, Agent, or Firm* — Horst M. Kasper

(57) ABSTRACT

The invention relates to an external handle on doors or hatches of vehicles, using a two piece (10, 20) housing, wherein a cavity (21) is generated between said pieces. A sensor (31, 32) is arranged in said cavity in a container (30). On operation, the sensor carries out certain functions in the lock. According to the invention, failures caused by the ingress of fluids into the cavity (21) can be avoided, wherein the container (30) is formed from an elastic molded mass (35), in which the sensor (31, 32) and optionally some further electric and/or electronic components for the sensor operation are embedded. An elastic surface (36) is achieved on at least one end piece of the container (30) by means of the molded mass (35). When assembled, the container (30) is pressed (41) with said elastic surface (36) against an inner surface (29) of the housing piece (10, 20). On pressing (41), the end piece of the container (30) deforms and functions as sealing means (40'), preventing an ingress of fluid between the container surface (36) and the housing inner surface (29).

19 Claims, 2 Drawing Sheets

(56) References Cited

U.S. PATENT DOCUMENTS

Figure 1:
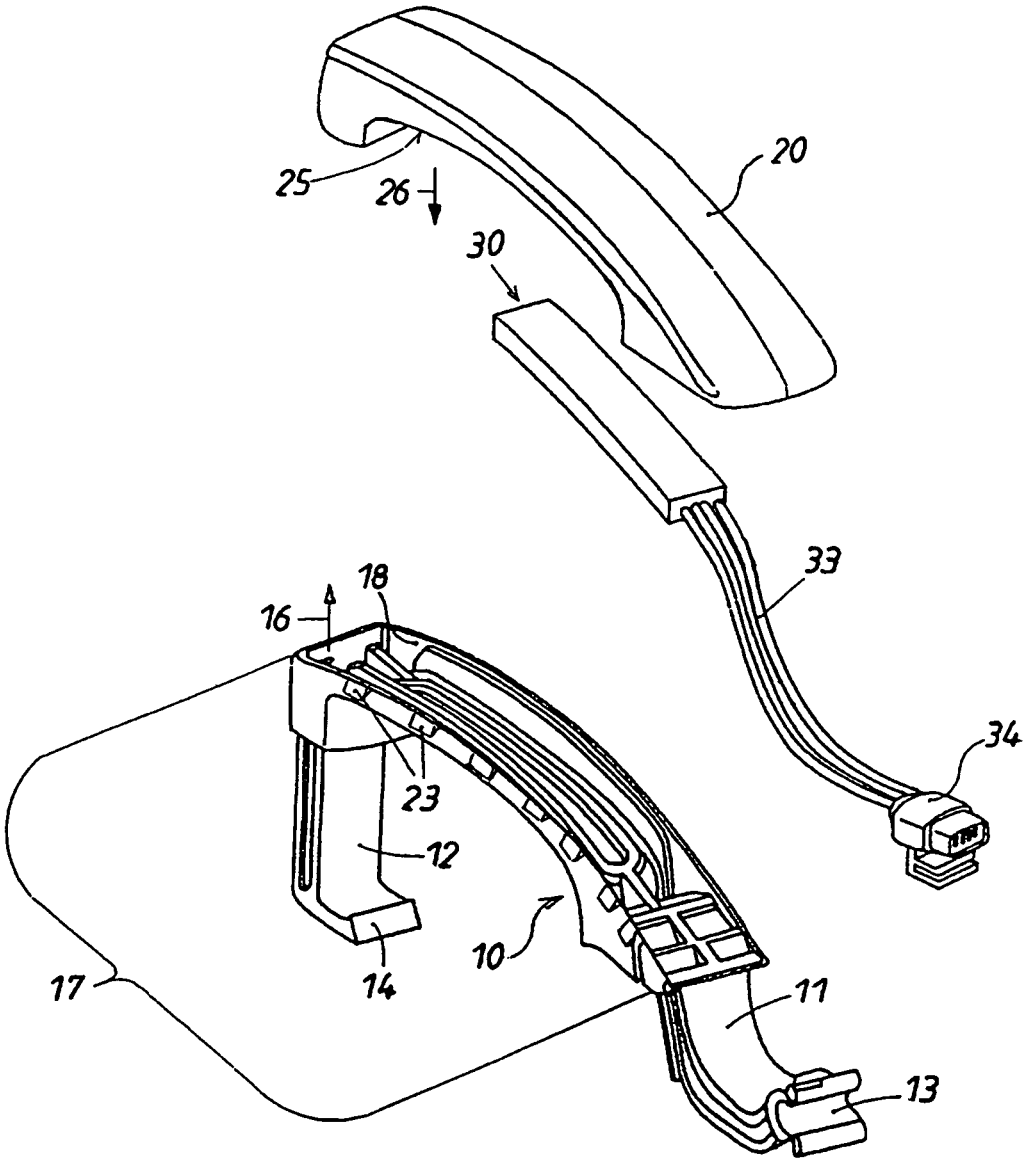

| | | | | |
|---|---|---|---|---|
| 6,998,968 | B2 * | 2/2006 | Garnault et al. | 340/426.28 |
| 7,091,823 | B2 * | 8/2006 | Ieda et al. | 340/5.72 |
| 7,173,346 | B2 * | 2/2007 | Aiyama et al. | 307/9.1 |
| 7,217,899 | B2 * | 5/2007 | Hidaka et al. | 200/600 |
| 7,597,364 | B2 * | 10/2009 | Muneta | 292/80 |
| 2003/0001729 | A1 | 1/2003 | Ieda et al. | |
| 2003/0019261 | A1 * | 1/2003 | Wittwer | 70/257 |
| 2003/0122556 | A1 | 7/2003 | Sueyoshi et al. | |
| 2005/0212308 | A1 * | 9/2005 | Makino et al. | 292/336.3 |
| 2005/0230237 | A1 * | 10/2005 | Ieda et al. | 200/600 |
| 2007/0182166 | A1 * | 8/2007 | Schindler et al. | 292/336.3 |
| 2007/0216175 | A1 * | 9/2007 | Tanimoto et al. | 292/336.3 |

FOREIGN PATENT DOCUMENTS

| | | |
|---|---|---|
| DE | 19935290 | 8/2001 |
| DE | 10229446 | 3/2003 |
| DE | 102005046119 | 3/2007 |
| EP | 1284335 | 2/2003 |
| EP | 1582659 | 10/2005 |
| GB | 2421799 | 12/2004 |

* cited by examiner

EXTERNAL HANDLE ON DOORS OR HATCHES OF VEHICLE

The invention is directed to a door outer grip of the kind indicated in the preamble of claim 1, wherein the door outer grip exhibits a two part casing. This casing comprises a grip body, wherein the body in the case of assembly serves both for the application of the door outer grip at the door as well as for opening a lock furnished at the door. The other part of the casing is a grip cover. A hollow chamber is generated between the grip cover and the grip body and the hollow chamber serves for receiving a container.

The German printed Patent Document DE 199 35 290 A1 shows such a door outer grip. In case the electronic container is formed as an electrical sensor, problems are generated by liquids entering into the interior of the hollow chamber. The slots between the surfaces of the container and the inner faces of the casing attract liquids by capillary action. Then the sensor is non-fit for use.

It is an object of the present invention to develop a door outer grip of the kind recited in the preamble of claim 1, which door outer grip eliminates this problem. This is accomplished by the steps recited in claim 1, which steps have the following particular importance.

An elastic mold compound is employed for the formation of the container, wherein the sensor and/or at least several electrical and/or electronic device components serving for sensor operation are embedded in the elastic mold compound. This mold compound generates an elastic surface at least one end piece of the container, wherein the elastic surface is pressed against the inner face of the casing cover or of the casing body in an assembly situation. The end piece of the container is deformed in connection with this pressing on and serves as sealing means, which prevent the penetration of liquid to between the container surface and the casing interior face. The capability of functioning of the sensors is therefore not any longer interfered with by liquids entering into the sensors.

The construction according to the invention is of particular importance in connection with capacitive acting sensors, which generate an electrical field. The mold mass of the container serves in fact as a dielectric for the electric field. Where penetrating liquids are prevented according to the invention to enter into this region, thus these liquids cannot also falsify the physical properties of the dielectric.

Figure 2A:
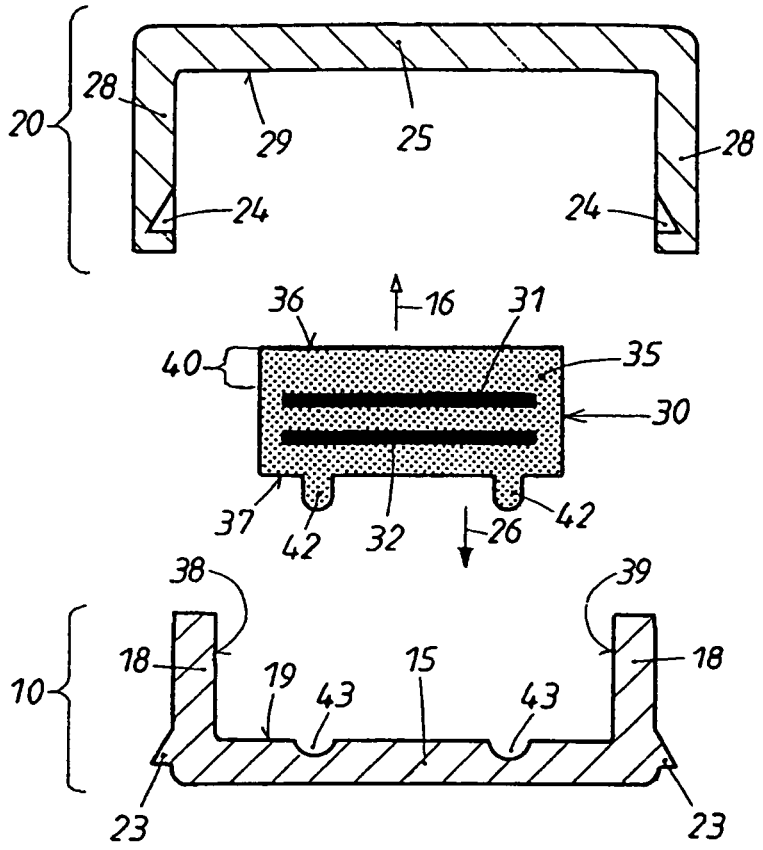
Figure 2B:
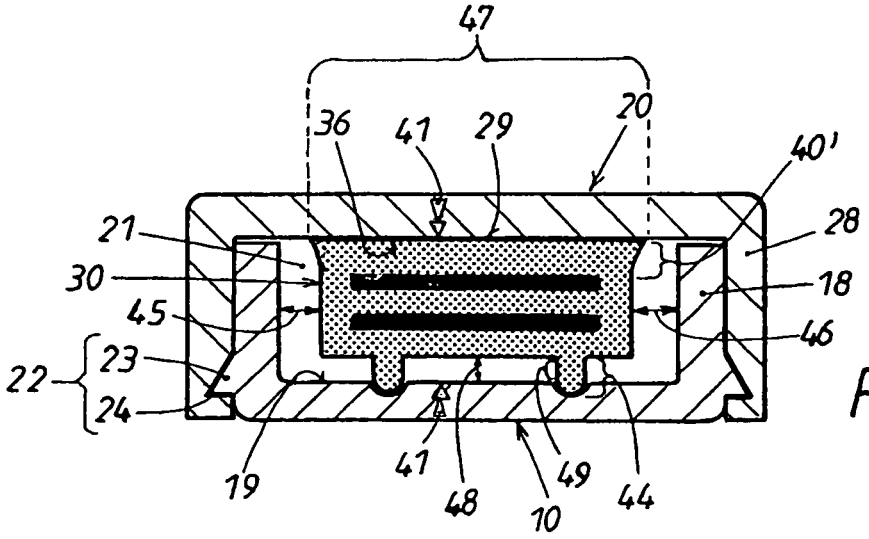

Further steps and advantages of the invention result from the sub claims, the following description and the drawings. The invention is shown in the drawing by way of an embodiment example. There is shown in:

FIG. 1 a perspective view of an exploded presentation of the construction principle of the invention door outer grip, FIG. 2 a schematic cross-sectional view through the components of the invention door outer grip prior to assembly in an exploded representation corresponding to FIG. 1 wherein the dimensions of a container disposed in the interior of the outer grip, and FIG. 2*b* the same cross-section, however after the assembly of the grip components of FIG. 2*a*, wherein the changed dimensions of the container are also drawn.

The door outer grip is formed as a two part casing as shown in FIG. 1, namely with a grip body 10 and a grip cover 20 covering this grip body 10. The grip body 10 has two ends 11, 12 with different functions. The one body end 11 is furnished on an end side with a pivot bearing position 13, which engages at a counter bearing position of a carrier not shown in detail when the door outer grip is built-in. The carrier is attached at the door or hatch of a vehicle. Consequently, this body end 11 is a bearing end and serves for supporting the door outer grip at the door of the vehicle.

The other body end 12 is formed as an extension arm and furnished with an end side hook 14, wherein the hook 14 grips behind a starting member of a lock not shown in detail in the door or hatch of the vehicle. The starting member is captured through the hook 14 upon actuation of the door outer grip and the lock is actuated. This second body end 12 is also the actuation end of the door outer grip. A middle section 17 of the grip body 10 is formed as a shell 15, where the shell 15 is open toward the outside, namely in the sense of the arrow 16.

The grip cover 20 is coordinated primarily in the middle section 17 of the grip body 10 and formed as a counter shell 25, which counter shell 25 exhibits its in the direction of the inwardly directed arrow 26. FIG. 2*b* shows the assembly case between the grip body 10 and the grip cover 20. Then the shell 15 and the counter shell 25 engage into each other with their side walls 20, 28. A hollow chamber 21 is generated between the shell 15 and the counter shell 25 and the height of the hollow chamber is designated with 52 in FIG. 2*b*. The side walls 18, 28 gripping into each other are connected to each other. The connection can be furnished for example by snap-in locking devices 22, which devices comprise in the present case the snap in lock projection 23 at the outside of the shell side wall 18 and as a snap in lock recess 24 at the side of the counter shell side wall 28. Alternatively or additionally screwing means can be employed for securing the engagement position.

In the assembly situation, the hollow chamber 21 receives a particular container 30, where the container 30 is electrically connected to corresponding control device components and/or with a current source through various electrical signal and operational lines 33. The container 30 has the dimensions recognizable from FIG. 2*a*, that is the height 50*a* and the width 51*a* prior to the assembly of the door outer grip. After the assembly the dimensions change into the height 50*b* and width 51*b* according to FIG. 2*b*. An electrical plug 34 disposed at the end of the lines 33 serve for providing the electrical connection. Where the grip cover 20 is connected to the grip body 10, then the electrical lines 31 together with the plug 34 project at the bearing end 11 of the outer grip, where the lines 31 and plug 34 can be coupled with corresponding counter plugs not illustrated in detail.

The container 30 contains two electrodes 31, 32, which electrodes 31, 32 belong to two capacitive sensors having different effects as can be recognized from the cross section of FIG. 2*a*. The one sensor 31 serves for bolting the lock, whereas the other sensor 32 takes care of the unbolting of the lock. The two sensors 31, 32 respond when the hand of an authorized person approaches the first or, respectively, second electrode 31, 32 of the two sensors with the purpose of actuating the door outer grip.

The two electrodes 31, 32 are embedded in a casting mold mass 35 emphasized by a grid of points, wherein the casting mold mass 35 is formed elastically yielding. Further electronic and electric device components serving for operating the two sensors 31, 32 can be integrated in this casting mold mass 35. The outwardly or, respectively, inwardly directed surfaces 36, 37 in the sense of the two arrows 16, 26 drawn also in FIG. 2*a* are generated at the container 30 through the casting mold mass 35. The end piece 40 of the container 30 consisting of elastic plastic is of particular importance, which end piece 40 surrounds the container surface 36. The latter end piece 40 has a particular effect recognizable from FIG. 2*b* in case of assembly.

FIG. 2*b* shows the assembly case of the two casing shells 10, 20, which shells 10, 20 exert a pressure illustrated by force arrows 41 on the container 30 disposed in the hollow chamber 21. The hollow chamber 21 has a height 52 as shown in FIG. 2*b* in the case of assembly. The elastic container end piece 40 of FIG. 2*a* is deformed according to the pressure forces 41 in the sense of the shape 40' recognizable from FIG. 2*b*. Prior to assembly, the container (30) has a larger height 50a as would correspond to the height of the hollow chamber 21 according to FIG. 2*a*, which hollow chamber 21 is generated between two casing shells 10, 20 according to FIG. 2*b* in the assembly case. The elastic mass 35 of the container 30 is displaced in the hollow chamber 21 in case of assembly. As a consequence, the container surface 36 is pressed against the inner face 29 of the casing cover 20. The container end piece 40 is a sealing agent based on its deformation 40'. As a comparison between FIGS. 2*a* and 2*b* shows, the width 51 a of the container 30 has increased to the larger dimension 51*b* based on its deformation. This sealing agent 40' prevents a penetration of possible liquid in the hollow chamber 21 between the container surface 36 and the casing inner face 29. There a press on zone 47 recognizable from FIG. 2*b* is generated, which press on zone 47 principally excludes a capillary action of the liquid in this region.

An analogous sealing effect could, if required, also be performed on the oppositely disposed container surface 37 relative to the grip body inner face 19. Such press on zones 47 could also be generated simultaneously at several face sides of the container. Particular positioning means 44 exist however there, which positioning means 44 take care of a defined position of the container 30 in the hollow chamber 21.

The positioning means 44 comprise a projection 42 at the inwardly 26 directed container surface 37 on the one hand and a complementary recess 43 at the outwardly directed inner face 19 of the grip body 10 on the other hand according to the illustrated embodiment example. The engagement position of the two positioning means parts 42, 43 can be recognized in FIG. 2*b*. This assures the lateral distance 45, 46 of the container 30 relative to the inner faces 38, 39 of the inner side walls 28. This can be recognized out of a combined view of FIGS. 2*a*, 2*b*. It is understood that instead of the recess 43 also other positioning means, such as for example a counter projection at the grip body 10 could be furnished. The press on pressure 41 is exerted onto the container 30 through the positioning means 44 in the assembly case of FIG. 2*b*, whereby the elastic end piece 40 of the container 30 according to FIG. 2*a* becomes a sealing agent 40' of FIG. 2*b*.

The positioning means 44 take care of a distance 48 between the container 30 and the inner face of the grip body 10 in the present case. This distance 48 is formed so large that a capillary action of entering liquid into the hollow chamber 21 is prevented. Despite of the liquids; the capability of functioning of the sensor or, respectively, of the sensors 31, 32 is maintained. The projection 42 with its projection residue 49 projecting out of the oppositely disposed recess 43 could be considered as a "distance spacer" for the container 30 in the hollow chamber 21 in the present case. This distance spacer 49 is as mentioned formed as a single piece with the container surface 37, since the projections 42 are formed there. Therefore the container 30 and the distance spacer 49 form a preassembled device unit. The projections 42 or, respectively, the distance spacer 49 are formed as a single piece together with the container 30.

Such single piece form of a distance spacer could of course also be formed in an analogous fashion with the inner faces 19, 29 of the two grip components 10, 20 or with the surfaces of the grip cover 25. Finally, it is also possible to employ separate, preproduced inserts as distance spacers, which are used in these regions.

The sensors 31, 32 are active as a capacitance in the present case and they generate an electrical field, which extends through the sealed off press on zone 47 of the container. The elastic casting mold mass 35 of the container 30 is the dielectric for the electrical field. The faces of the capacitor of the one or, respectively, the two capacitive sensors 31, 32 are running essentially parallel to the sealed off press on zone 47 of the container in case of assembly. Of course also other sensors can be employed instead of the capacitive sensors.

LIST OF REFERENCE CHARACTERS

10 grip body (FIGS. 1 to 2*b*)
11 first body end of 10, application end
12 second body end of 10, actuation end
13 pivot bearing position at 11
14 hook at 12
15 shell of 10 (FIG. 1, 2*a*)
16 arrow directed toward the outside
17 middle section of 10
18 side wall of 15
19 inner face of 10 directed toward the outside 16
20 grip cover (FIGS. 1 to 2*b*)
21 hollow chamber between 15, 25
22 snap in locking device between 15, 25
23 snap in lock projection of 22 at 10
24 snap in lock recess of 22 at 10
25 counter shell of 20 (FIG. 2*a*)
26 arrow directed towards the inside
28 side wall of 25
29 cover inner face of 20 (FIG. 2*a*, 2*b*) directed toward the inside 26
30 container (FIGS. 1 to 2*b*)
31 first electrode of 30, capacitive sensor for bolting
32 second electrode, capacitive sensor for unbolting
33 electrical lines for signals and operating voltage
34 electrical plug at 33
35 elastic casting mold mass of 30 (FIG. 2*a*)
36 container surface of 30 (FIGS. 2*a*, 2*b*) pointing toward the outside 16
37 container surface of 30 (FIGS. 2*a*, 2*b*) pointing toward the inside 26
38 first lateral inner face of 10 (FIG. 2*a*)
39 second lateral inner face of 10 (FIG. 2*a*)
40 end piece of 30
40' deformation of 40, sealing agent
41 force arrow for pressure between 10, 20 on 30 (FIG. 2*b*)
42 projection of 44 (FIG. 2*a*)
43 recess of 44 (FIG. 2*a*)
44 positioning means of 30 in 21 (FIG. 2*b*)
45 left distance of 30 versus 18 (FIG. 2*b*)
46 right distance of 30 versus 18 (FIG. 2*b*)
47 press on zone between 30, 20 (FIG. 2*b*)
48 distance between 30, 10 (FIG. 2*b*)
49 projection residue of 42, sealing agent (FIG. 2*b*)
50*a* total height of 30 prior to assembly (FIG. 2*a*)
50*b* total height of 30 after the assembly (FIG. 2*b*)
51*a* width of 30 prior to assembly (FIG. 2*a*)
51*b* width of 30 after assembly (FIG. 2*b*)
52 height of 21 after assembly (FIG. 2*b*)

The invention claimed is:

1. Outer grip at doors or hatches of vehicles, with a two-part casing (10, 20) comprising a grip body (10) and a grip cover (20), which is solidly connectable (22) to the grip body (10), wherein the grip body (10) is pressed against the grip cover (20), wherein side walls (18) of the grip body (10) and side walls (28) of the grip cover (20) are driven into each other up to making a connection (22) and wherein a container (30) is disposed in between, wherein a hollow chamber (21) for the container (30) is generated between the grip body (10), the grip cover (20), and their side walls, wherein the container (30) comprises an elastically yielding mass (35), wherein a sensor (31, 32) or at least some of electrical or electronic device components serving for sensor operation are embedded in the elastically yielding mass (35), wherein the sensor (31, 32) is capacitively effective in case of use and generates an electrical field, wherein the elastic casting mold mass (35) of the container (30) forms the dielectric for the electrical field, wherein the elastically yielding mass (35) of the container (30) has at least an elastical end piece (40), wherein the elastical end piece (40) is free from sensors (31, 32) and device components of the container (30), wherein the container (30) has prior to assembly a total height (50a) in the region of this end piece, which total height is larger than the height of the hollow chamber (21) receiving the container (30), whereby the container (30) exhibits an over-height relative to the hollow chamber (21), wherein a deformation (40') of the end piece (40) occurs during assembly because of this over-height of the container (30), wherein the deformation (40') presses at least one outwardly directed surface (36) of the container (30) against an inner face (29) of the grip casing (10, 20) whereby a press on zone (47) is generated, wherein the electrical field extends through the press on zone (47), wherein the press on zone (47) renders the container (30) to be a sealing agent relative to the grip casing (10, 20), and that a liquid penetrating into the hollow chamber (21) of the door outer grip does not pass into the press on zone (47) of the container end piece (40) and does not falsify the properties of the dielectric.

2. Outer grip according to claim 1 characterized in that positioning means (44) are disposed at the container opposite to the press on zone (47) of the container.

3. Outer grip according to claim 1, characterized in that the positioning means (44) in an assembled case transfer the press on pressure (41) exerted between the casing cover (20) and the casing body (10) onto the container (30).

4. Outer grip according to claim 2, characterized in that positioning means (44) at the same time take care of a distance (49) between the container surface (37) and the casing inner face (19), and that this distance (49) prevents a capillary action of liquids entering into the hollow chamber (21) and takes care of a capability of functioning of the sensors (31, 32) despite the liquids.

5. Outer grip according to claim 4, characterized in that the positioning means (44) comprise the distance spacer (49), wherein the distance spacer (49) is supported shape matchingly at a casing inner face (19) and/or the container (30) and wherein the distance spacer (49) determines in this way the position (45, 46) of the container (30) in the hollow chamber (21) of the grip.

6. Outer grip according to claim 5, characterized in that the distance spacer is attached on an inwardly directed (26) container surface (37) and forms together with the container (30) a preassembled device component.

7. Outer grip according to claim 5, characterized in that the distance spacer is attached at the inner face of the grip body or of the grip cover and forms together with the grip body or the grip cover a preassembled device component.

8. Outer grip according to claim 4, characterized in that the distance spacer (49) is formed as a single piece with the grip cover, the container (30) and/or the grip body.

9. Outer grip according to claim 4, characterized in that the distance spacer is a component of a preproduced insert, that the insert for the first time during the assembly is disposed between oppositely directed inner faces or, respectively, surfaces of the grip cover (20), of the container (30) and/or the grip body (10), and that the distance spacers of the insert are supported in the finished door outer grip at the inner faces or, respectively, surfaces disposed in the hollow chamber and allow a flowing of liquid in the hollow chamber free of capillary action.

10. Outer grip at doors or hatches of vehicles, with a two-part casing (10, 20) comprising a grip body (10) and a grip cover (20), which is solidly connectable (22) to the grip body (10), wherein the grip body (10) is pressed against the grip cover (20), wherein side walls (18) of the grip body (10) and side walls (28) of the grip cover (20) are driven into each other up to making a connection (22) and wherein a container (30) is disposed in between, wherein a hollow chamber (21) for the container (30) is generated between the grip body (10), the grip cover (20), and their side walls, wherein the container (30) comprises an elastically yielding mass (35), wherein a sensor (31, 32) or at least some of electrical or electronic device components are embedded in the elastically yielding mass (35), wherein the container has made of its elastically yielding mass (35) at least an elastical end piece (40), wherein the elastical end piece (40) is free from sensors (31, 32) and device components of the container (30), wherein the container (30) has prior to assembly a total height in the region of this end piece, which total height is larger than the height of the hollow chamber (21) receiving the container (30), whereby the container (30) exhibits an over-height relative to the hollow chamber (21), wherein a deformation (40') of the end piece (40) occurs during assembly because of this over-height of the container (30), wherein the deformation (40')presses at least one outwardly directed surface (36) of the container (30) against an inner face (29) of the grip casing (10, 20) whereby a press on zone (47) is generated, wherein the press on zone (47) renders the container (30) to be a sealing agent relative to the grip casing (10, 20), wherein the sensor (31, 32) is capacitively effective in case of use and generates an electrical field, which electrical field extends through the sealed surface (36) of the container (30), wherein the elastic casting mold mass (35) of the container (30) forms the dielectric for the electrical field, and that a liquid penetrating into the hollow chamber (21) of the door outer grip does not pass into the press on zone (47) of the container end piece (40, 40') and does not falsify the properties of the dielectric.

11. Outer grip according to claim 1, characterized in that the sealed press on zone (47) of the container (30) is disposed at the inner face (29) of the grip cover (20), and that the capacitor face (31, 32) of the capacitive sensor in an assembly case runs essentially parallel to the inner face (29) of the casing cover (20).

12. Outer grip according to claim 11, characterized in that the container (30) is equipped with two capacitive sensors (31, 32) having relative to each other different effects, which sensors are set effective in case of a spatially different approach of the hand of an authorized vehicle user.

13. Outer grip according to claim 12, characterized in that the first sensor (31) set active serves for bolting a lock coordinated to the door outer grip, while the second sensor (32) set active effects an unbolting of the lock;

wherein recesses (43) are placed in the inner face (19) of a shell (15) of the grip body (10) and wherein projections (42) are placed on the bottom container surface (37) of the container (30), wherein the projections (42) engage into corresponding and complementary recesses (43) for assuring a lateral distance (45, 46) of the container (30) relative to inner faces (38, 39) of the inner side walls (28) of the grip cover (20).

14. Outer grip according to claim 1 wherein positioning means (44) are disposed at the container (30) opposite to a press on zone (47) of the container (30);

wherein the positioning means (44) furnish a defined position of the container (30) in the hollow chamber (21);

wherein the positioning means comprise a projection (42) at an inwardly (26) directed container surface (37) and a complementary recess (43) at an outwardly directed inner face (19) of the grip body (10) for establishing a first lateral distance (45) relative to a first inner face (38) and a second lateral distance (46) relative to a second inner face (39);

wherein the press on pressure (41) is exerted onto the container (30) through the positioning means (44) in an assembly case, wherein the elastic end piece (40) becomes a sealing agent (40');

wherein the positioning means (44) furnishes [[a]] the container (30) bottom distance (48) between a bottom container surface (37) and an inner face (19) of the grip body (10);

wherein the container (30) bottom distance (48) is formed so large that a capillary action of entering liquid into the hollow chamber (21) is prevented;

wherein the capability of functioning of the sensors (31, 32) is maintained;

wherein the projection (42) with its projection residue (49) projecting out of the oppositely disposed recess (43) can be considered as a "distance spacer" for the container (30) in the hollow chamber (21);

wherein the distance spacer (49) is formed as a single piece with a container surface (37), since the projections (42) are formed here;

wherein the container (30) and the distance spacer (49) form a preassembled device unit;

wherein the projections (42) or the distance spacer (49) are formed together with the container (30) as a single piece.

15. Outer grip at doors or hatches of vehicles, comprising a grip body (10) having a shell (15) bottom with a body inner face (19) and having a shell side wall (18) extending upwardly from a periphery of the shell (15) bottom;

a snap-in lock projection (23) disposed at the outside of the shell side wall (18);

a grip cover (20) having a counter shell (25) top with a cover inner face (29) and a counter shell side wall (28) extending downwardly from a periphery of the counter shell (25) top;

a snap in lock recess (24) disposed at the inside of the counter shell side wall (28) and for lockingly engaging the snap-in lock projection (23);

a hollow chamber (21) disposed between the shell (15) bottom and the counter shell (25) top;

a deformable container (30) consisting of an elastic casting mold mass (35) and to be placed into the hollow chamber (21) and having a bottom container surface (37) facing the body inner face (19) and having a top elastic container surface (36) facing the cover inner face (29);

a sensor (31, 32) disposed in the container (30), wherein the sensor (31, 32) on actuation releases at least one predetermined function in a lock, wherein the sensor (31, 32) and/or at least several of the electrical and/or electronic device components serving for sensor operation are embedded in the container (30);

an end piece (40) of the elastic casting mold mass (35) furnishing an elastic top container surface (36) at the container (30), which upon exertion of external forces on the shell (15) bottom and on the counter shell (25) top then the deformable container (30) will deform and expand along the elastic top container surface (36);

wherein the container (30) with this elastic top container surface (36) is pressed (41) against the cover inner face (29) of the cover grip (20) and that the end piece (40) of the container (30) deforms during the pressing on (41) and is a sealing agent (40'), which sealing agent (40') prevents capillary penetration of liquid between the elastic top container surface (36) and the cover inner face (29), wherein the sensor (31, 32) is capacitively effective in case of use and generates an electrical field, which electrical field extends through the sealed top container surface (36) of the container (30), wherein the elastic casting mold mass (35) of the container (30) forms the dielectric for the electrical field, and that a liquid penetrating into the hollow chamber (21) of the door outer grip does not pass into a press on zone (47) of the container end piece (40, 40') and does not falsify the properties of the dielectric.

16. Outer grip according to claim 15, wherein positioning means (44) are disposed at the container opposite to the press on zone (47) of the container;

wherein the positioning means (44) transfer the press on pressure (41) exerted between the grip cover (20) and the grip body (10) onto the container (30) at the bottom container surface (37) and a complementary recess (43) of the body inner face (19) of the grip body (10);

wherein the positioning means (44) comprise a projection (42) of the bottom container surface (37);

wherein the positioning means (44) assure a defined position of the container (30) in the hollow chamber (21);

wherein the positioning means (44) at the same time take care of the container (30) bottom distance (48) between the bottom container surface (37) and the body inner face (19) of the grip body (10), and that this container (30) bottom distance (48) prevents a capillary action of liquids entering into the hollow chamber (21) and takes care of a capability of functioning of the sensors (31, 32) despite the liquids;

wherein the shell side wall (18) is disposed within the counter shell side wall (28).

17. Outer grip according to claim 15 wherein the positioning means (44) comprise a distance spacer (49), wherein the distance spacer (49) is supported shape matchingly at the casing inner face (19) or the container (30) and wherein the distance spacer (49) determines in this way the position (45, 46) of the container (30) in the hollow chamber (21) of the grip;

wherein the distance spacer (49) is attached on the inwardly directed (26) bottom container surface (37) of the container (30) and forms together with the container (30) a preassembled device component;

wherein the distance spacer is attached at the body inner face of the grip body or of the grip cover and forms together with the grip body or the grip cover a preassembled device component;

wherein the distance spacer (49) is formed as a single piece with the grip cover, the container (30) or the grip body;

wherein the distance spacer is a component of a preproduced insert, that the insert for the first time during the assembly is disposed between oppositely directed inner faces or, respectively, surfaces of the grip cover (20), of the container (30) and/or the grip body (10), and that the distance spacers of the insert are supported in the finished door outer grip at the inner faces or, respectively, surfaces disposed in the hollow chamber and allow a flowing of liquid in the hollow chamber free of capillary action.

18. Outer grip according to claim 15, wherein the sensor (31, 32) is capacitively effective in case of use and generates an electrical field, which electrical field extends through the sealed top container surface (36) of the container (30), wherein the elastic casting mold mass (35) of the container (30) forms the dielectric for the electrical field, and that a liquid penetrating into the hollow chamber (21) of the door outer grip does not pass into the press on zone (47) of the container end piece (40, 40') and does not falsify the properties of the dielectric;

wherein the sealed press on zone (47) of the container (30) is disposed at the cover inner face (29) of the grip cover (20), and that the capacitor face (31, 32) of the capacitive sensor in an assembly case runs essentially parallel to the cover inner face (29) of the casing cover (20);

wherein the container (30) is equipped with two capacitive sensors (31, 32) having relative to each other different effects, which sensors are set effective in case of a spatially different approach of the hand of an authorized vehicle user;

wherein the first sensor (31) set active serves for bolting a lock coordinated to the door outer grip, while the second sensor (32) set active effects an unbolting of the lock.

19. Outer grip according to claim 15, wherein the container (30) consists of an elastic casting mold mass (35);

a projection (42) disposed at an inwardly (26) directed container surface ($^{37}$);

wherein the grip body (10) is formed as an elongated trough having a lower flat band inner face with recesses (43);

wherein upwardly directed side walls (18) with their lower ends join side edges of the lower flat band elongated inner face (19) to form an elongated grip body (10);

wherein the grip cover (20) is formed as an upper elongated inverted trough having an upper flat band inner face, wherein downwardly directed side walls (28) with their upper ends join side edges of the upper band elongated inner face (29) to form the elongated grip cover (20).

* * * * *